US007271715B2

(12) United States Patent
Aupperle et al.

(10) Patent No.: US 7,271,715 B2
(45) Date of Patent: Sep. 18, 2007

(54) PERSONAL ARTICLES TRACKING

(75) Inventors: Bryan Eric Aupperle, Cary, NC (US); James Merwin Mathewson, II, Chapel Hill, NC (US)

(73) Assignee: International Business Machines Corporation, Armonk, NY (US)

( * ) Notice: Subject to any disclaimer, the term of this patent is extended or adjusted under 35 U.S.C. 154(b) by 623 days.

(21) Appl. No.: 10/663,947

(22) Filed: Sep. 16, 2003

(65) Prior Publication Data

US 2005/0068168 A1 Mar. 31, 2005

(51) Int. Cl.
*G08B 1/08* (2006.01)

(52) U.S. Cl. ..... 340/539.13; 340/539.1; 340/539.11; 340/539.21; 340/539.23; 340/539.32; 340/568.1; 340/572.1

(58) Field of Classification Search ..... 340/539.13, 340/539.1, 539.11, 539.15, 539.21, 539.23, 340/539.32, 568.1, 568.5, 568.6, 568.7, 571, 340/572.1, 573.1

See application file for complete search history.

(56) References Cited

U.S. PATENT DOCUMENTS 6,331,817 B1 * 12/2001 Goldberg ..... 340/573.1
6,611,556 B1 * 8/2003 Koerner et al. ..... 375/224
6,747,555 B2 * 6/2004 Fellenstein et al. ..... 340/524
6,996,402 B2 * 2/2006 Logan et al. ..... 455/456.1
7,034,684 B2 * 4/2006 Boman et al. ..... 340/568.1

* cited by examiner

*Primary Examiner*—Daryl C Pope
(74) *Attorney, Agent, or Firm*—Jeanine Ray-Yarletts, Esq.; Steven M. Greenberg, Esq.; Carey Rodriguez Greenberg & Paul LLP

(57) ABSTRACT

A personal articles tracking system, method and apparatus. In the system of the invention, a radio frequency identification (RFID) reader can be coupled to a tracking processor. A data store further can be configured to store tag data from corresponding RFID tags. Finally, an alert can be programmed to activate when the tracking processor no longer can sense within range of the RFID reader an RFID tag having corresponding tag data stored in the data store.

6 Claims, 5 Drawing Sheets

PERSONAL ARTICLES TRACKING

BACKGROUND OF THE INVENTION

1. Statement of the Technical Field

The present invention relates to the radio frequency identification (RFID) and more particularly to tracking personal articles via RFID.

2. Description of the Related Art

RFID is an area of automatic identification that has quietly been gaining momentum in recent years and is now being seen as a radical means of enhancing data handling processes, complimentary in many ways to other data capture technologies such bar coding. The object of any RFID system is to carry data in suitable transponders, generally known as tags, and to retrieve data, by machine-readable means, at a suitable time and place to satisfy particular application needs. Data within a tag may provide identification for an item in manufacture, goods in transit, a location, the identity of a vehicle, an animal or individual. By including additional data the prospect is provided for supporting applications through item specific information or instructions immediately available on reading the tag.

An RFID object tracking system requires, in addition to tags, a means of reading or interrogating the tags and some means of communicating the data to a host computer or information management system. In this respect, an RFID object tracking system also can include a facility for programming data into the tags. Notably, the tags can be active and powered in nature, or passive and unpowered in nature. Communication of data between tags and a reader can be by wireless communication. Two methods distinguish and categorize RFID object tracking systems, one based upon close proximity electromagnetic or inductive coupling and one based upon propagating electromagnetic waves. Coupling is via 'antenna' structures forming an integral feature in both tags and readers. While the term antenna is generally considered more appropriate for propagating systems it is also loosely applied to inductive systems.

RFID systems can be roughly grouped into four categories: electronic article surveillance (EAS) systems, portable data capture systems, networked systems and positioning systems. EAS systems typically involve a one bit system used to sense the presence or absence of an item. Portable data capture systems, by comparison, can be characterized by the use of portable data terminals with integral RFID readers and can be used in applications where a high degree of variability in sourcing required data from tagged items may be exhibited. Networked systems applications can generally be characterized by fixed position readers deployed within a given site and connected directly to a networked information management system. The transponders are positioned on moving or moveable items, or people, depending upon application. Finally, positioning systems use transponders to facilitate automated location and navigation support for guided vehicles.

Potential applications for RFID may be identified in virtually every sector of industry, commerce and services where data is to be collected. The attributes of RFID are complimentary to other data capture technologies and thus able to satisfy particular application requirements that cannot be adequately accommodate by alternative technologies. Principal areas of application for RFID that can be currently identified include: transportation and logistics, manufacturing and processing, and security. A range of miscellaneous applications further can be distinguished, including animal tagging, waste management, time and attendance, postal tracking, airline baggage reconciliation, and road toll management.

Despite many of the apparent advantages of RFID technology, deficiencies remain for some potential applications. Specifically, while RFID technology can be effective for garden variety inventory tracking, or for high speed vehicle logging, RFID technology heretofore has not been applied ubiquitously to generalized tracking of personal articles. Yet, in the modern era of accumulated personal articles, individuals must track manually a multiplicity of personal articles at any given time, such personal articles including jewelry, wallets, purses, cellular telephones, pagers, sunglasses and the like. Both the forgetfulness of individuals, in addition to thievery of others can result in the loss of substantially valuable personal articles.

SUMMARY OF THE INVENTION

A personal articles tracking system, method and machine readable storage can overcome the deficiencies of the prior art by registering identifying data associated RFID tags coupled to personal articles, and subsequently alerting the user when any one of the RFID tags in the registry no longer can be sensed in proximity to the user. In this way, the loss or theft of the personal article can be avoided. In accordance with a novel and non-obvious system aspect of the present invention, an RFID reader can be coupled to a tracking processor. A data store further can be configured to store tag data from corresponding RFID tags. Finally, an alert can be programmed to activate when the tracking processor no longer can sense within range of the RFID reader an RFID tag having corresponding tag data stored in the data store.

Importantly, in a preferred aspect of the invention, the tracking processor, RFID reader and alert can be disposed in a pervasive device. In this regard, the alert can be communicatively linked to an audiovisual presentation layer provided by the pervasive device, such as an LCD display and an audio speaker system. In this way, the enhanced presentation capabilities of the pervasive device can be used to provide more informative information to the end user (such as the identity of the lost personal article) beyond mere rudimentary alert techniques (such as a beep). Additionally, the alert further can include logic for notifying a third party of the activation through a communications link provided by the pervasive device. In this case, the alert can activate when the tracking processor no longer can sense within range of the RFID reader a specific RFID tag (indicating, for instance, that the pervasive device itself has been lost).

A method for tracking personal articles can include the steps of registering a plurality RFID tags in an inventory or tracked personal articles; sensing a plurality of proximate RFID tags; comparing the sensed proximate RFID tags to the registered RFID tags; and, producing an alert where not all of the registered RFID tags have been sensed. The producing step can include selecting a sub-set of the registered RFID tags; and, producing an alert wherein not all of the selected sub-set of the registered RFID tags have been sensed. Alternatively, the producing step can include accessing a presentation layer in a pervasive device; and, presenting the alert in at least one of an audio and visual form through the presentation layer in the pervasive. Finally, the producing step can include accessing a communications layer in a pervasive device; and, generating a cellular telephone call through the communications layer to a predetermined third-party to notify the third party that not all of the registered RFID tags have been sensed.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

The present invention is an RFID system for tracking personal articles and generating an alert when a tracked personal article has been lost, stolen or otherwise misplaced. In accordance with the present invention, RFID tags, including conventional inventory type RFID tags, can be affixed to personal articles which are to be tracked. A tracking processor can sense the presence of the RFID tags and can register the corresponding personal articles in a registry or inventory of tracked personal articles. Once an inventory of tracked personal articles has been established, the tracking processor can actively monitor the presence of each tracked personal article to ensure the proximity of the same. When any one tracked personal article falls outside of a threshold sensing range of the tracking processor, an alert can be issued so as to prevent the loss or theft of the personal article which has fallen outside of the threshold range.

Importantly, the tracking processor can be configured within a fob for a key chain, in an accessory for a pervasive device such as a personal digital assistant, wireless pager or telephone, or in association with any article of manufacture designed to remain principally in close proximity to its primary owner. Also, the tracking processor and selected tracked articles can be configured for communicative coupling to central command center either through cellular telephony or wireless data communications. In this way, when a selected tracked article or when the tracking processor falls outside the range of the tracking processor, the central command can be notified. The central command, in turn, can notify the primary owner of the loss. Optionally, the central command can notify other registered owners of the lost article. In this way, the registered owners can register the tag data for the lost article in their respective tracking processors which can locate the lost article of the lost article falls within range of the respective tracking processors.

Figure 1:
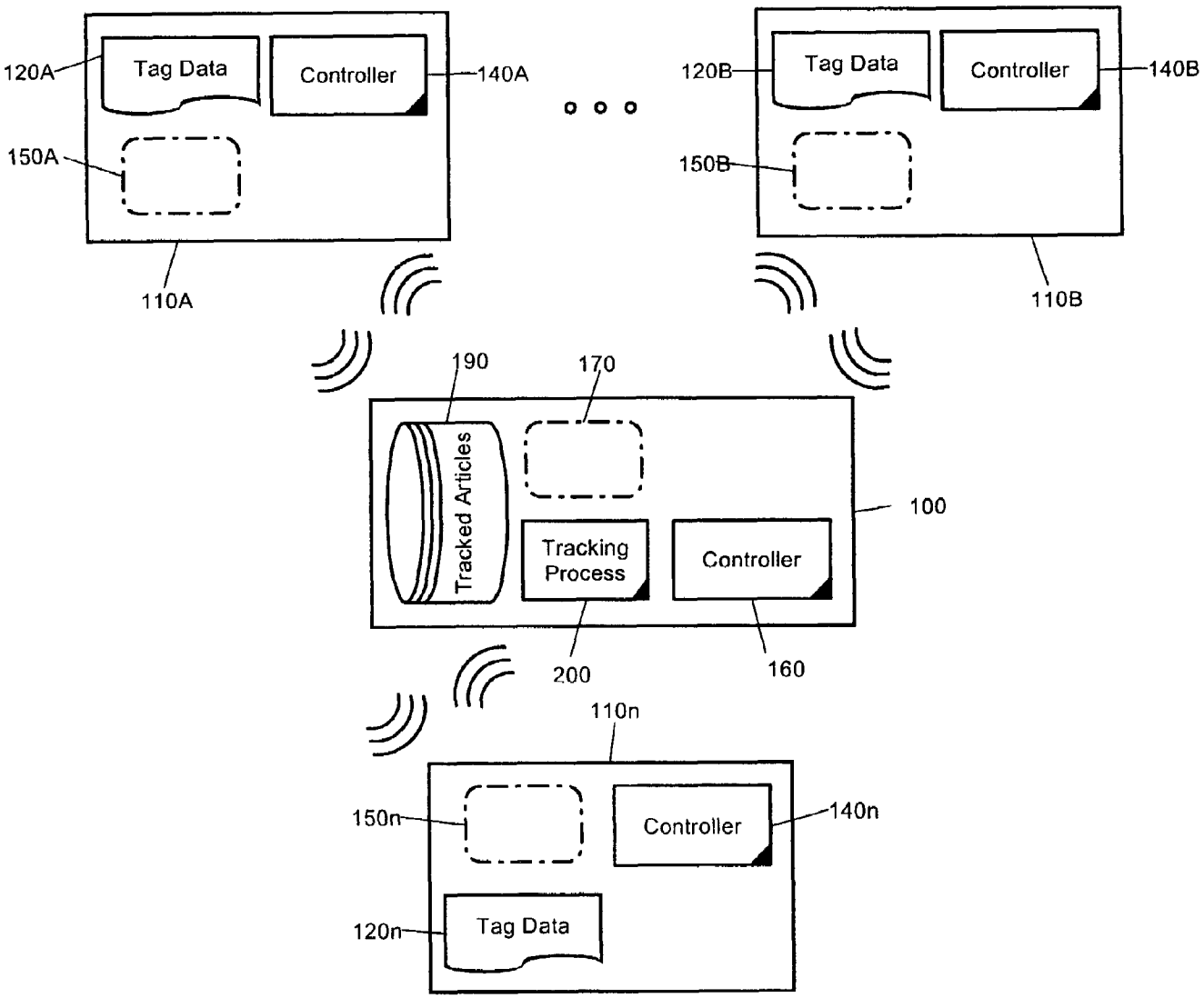
FIG. 1 is a block diagram illustrating an RFID system for tracking personal articles.

FIG. 1 is a block diagram illustrating an RFID system for tracking personal articles which has been configured in accordance with the present invention. In accordance with the present invention, one or more personal articles can be coupled to respective RFID tags 110A, 110B, 110*n*. Each RFID tag 110A, 110B, 110*n* can include tag data 120A, 120B, 120*n*, a controller 140A, 140B, 140*n*, and an antenna 150A, 150B, 150*n*. A tracking processor 100 similarly can be configured with an antenna 170 and a controller 160. Moreover, the tracking processor 100 can include a tracking processor 200 coupled to a data store 190 configured to store listings of tracked articles.

Each of the RFID tags 110A, 110B, 110*n* can be programmed with tag data 120A, 120B, 120*n* suitable to uniquely identify the respective RFID tags 110A, 110B, 110*n* to an interrogating tracking processor 100. During an interrogation process, the controller 140A, 140B, 140*n* can retrieve the tag data 120A, 120B, 120*n*. Subsequently, the controller 140A, 140B can wirelessly broadcast the tag data 120A, 120B, 120*n* via antennae 150A, 150B, 150*n* to the interrogating device in proximity to the RFID tag 110A, 110B, 110*n*.

In a passive implementation of the present invention, the controller 160 of the tracking processor 100 can broadcast radio frequency energy through antenna 170 so that the antennae 150A, 150B, 150*n* in each of the tags 110A, 110B, 110*n* can become energized. Upon receiving the broadcast radio frequency energy, the controller 140A, 140B, 140*n* can retrieve the tag data 120A, 120B, 120*n*. The controller 140A, 140B, 140*n* subsequently can encode and modulate the retrieved tag data 120A, 120B, 120*n* which can be rebroadcast using the antennae 150A, 150B, 150*n*. The rebroadcast energy can be received through antenna 170. Subsequently, the controller 160 can demodulate and decode the tag data 120A, 120B, 120*n*.

Figure 2:
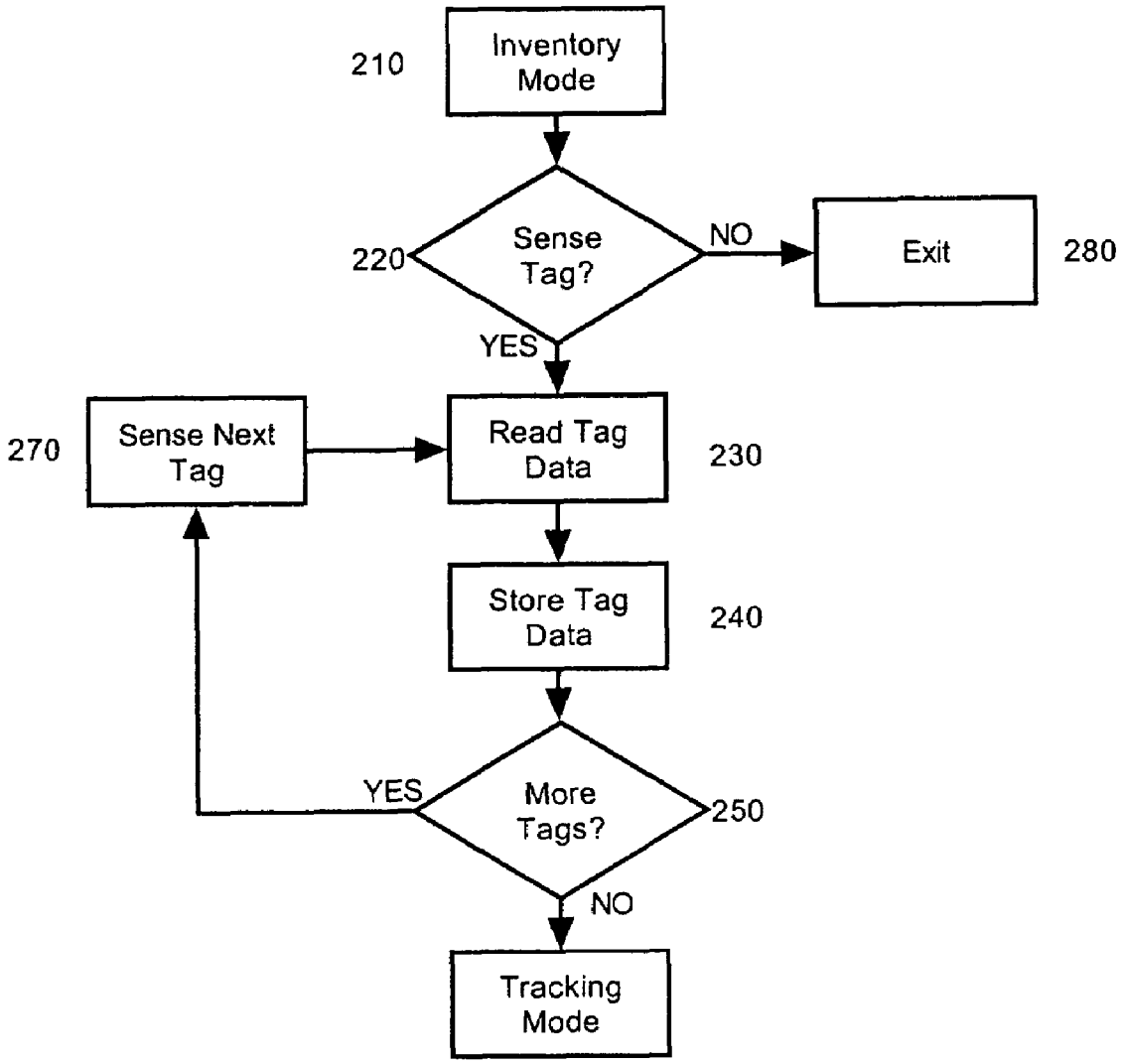
FIG. 2 is a flow chart illustrating a process for registering personal articles in the system of FIG. 1.
Figure 3:
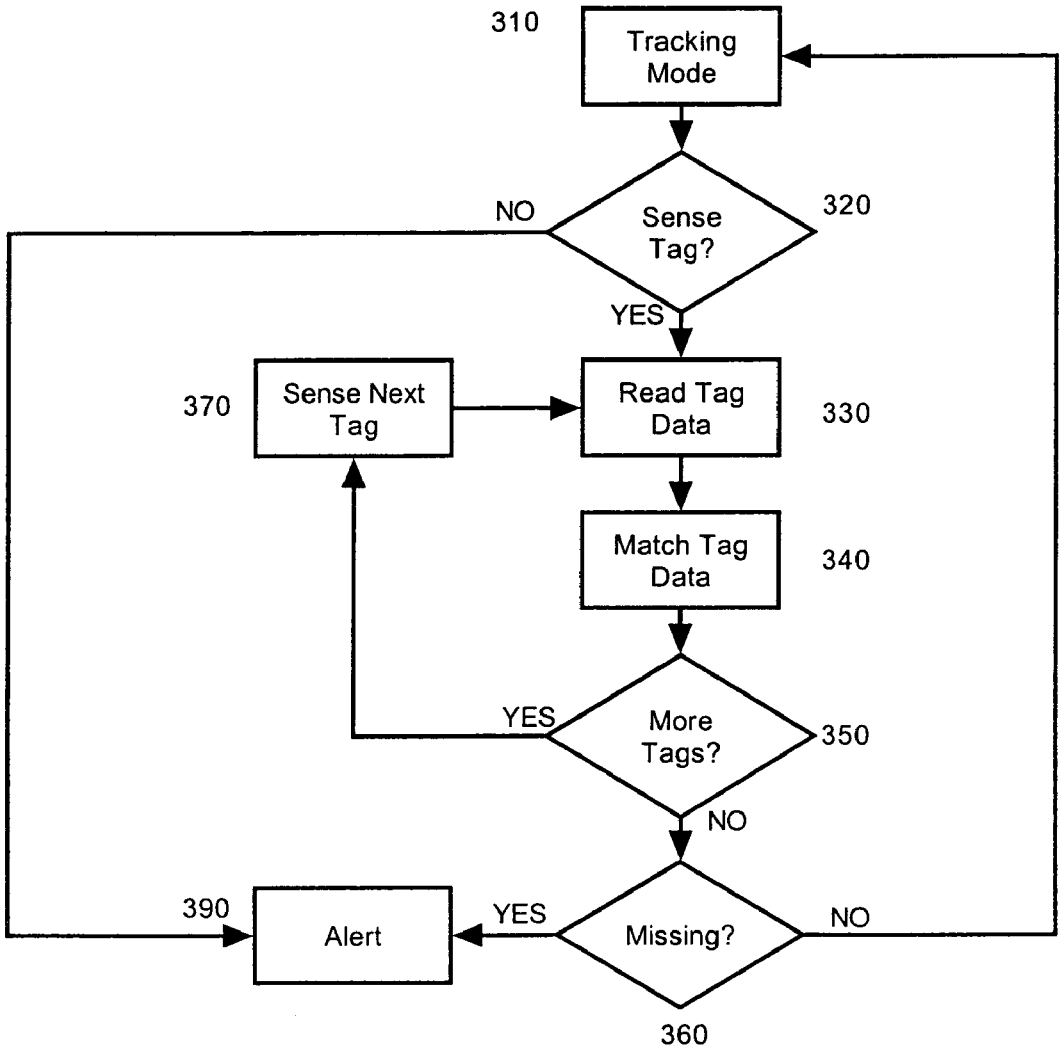
FIG. 3 is a flow chart illustrating a process for tracking registered personal articles in the system of FIG. 1.

Once the tag data 120A, 120B, 120*n* has been demodulated and decoded, the tracking processor 200 can process the tag data 120A, 120B, 120*n* both to register detected RFID tags 110A, 110B, 110*n* in the data store 190, and also to detect when an already registered RFID tag 110A, 110B, 110*n* no longer can be detected within a threshold range of the tracking processor 100. In this regard, FIG. 2 is a flow chart illustrating a process for registering personal articles in the system of FIG. 1 and FIG. 3 is a flow chart illustrating a process for tracking registered personal articles in the system of FIG. 1.

Generally, the tracking processor 200 can operate across two modes: an inventory mode and a tracking mode. In the inventory mode, proximately positioned articles within range of the tracking processor 200 can be registered with the tracking processor 200 so that when in tracking mode, the tracking processor 200 can ensure that the registered articles remain in range. When an article falls out of range in the tracking mode (e.g. the presence of the article no longer can be detected by the tracking processor 200), an alert can be actuated. Importantly, a third mode can be applied to the tracking processor 200—a profile mode.

Figure 4:
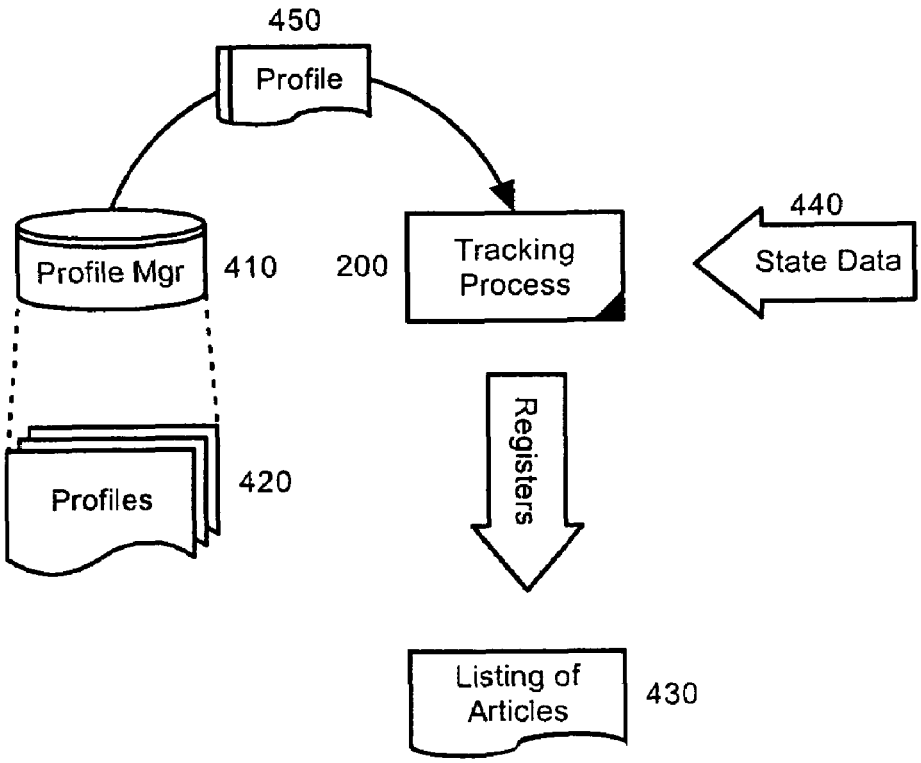
FIG. 4 is a block diagram illustrating the use of personal profiles for registering and tracking personal articles according to the RFID system of FIG. 1; and, FIG. 5 is a pictorial illustration of the RFID system of FIG. 1 deployed in association with a pervasive device.

FIG. 4 is a block diagram illustrating the use of personal profiles for registering and tracking personal articles according to the RFID system of FIG. 1. In the profile mode, collections of articles 430 can be registered with the tracking process 200 based upon a profile 450 selected from among a set of profiles 420. In particular, the set of profiles 420 can be established to include articles logically associated with external state data 440, such as the time of day, the weather, and the like. A profile manager 410 can provide an interface for establishing and maintaining the profiles 420 in the system of the present invention. In operation, the tracking process 200 can retrieve a contemporary profile 450, or the tracking process 200 can dynamically select a profile 450. In the case of a dynamic selection, the profile 450 can be selected according to particular state data 450.

As an example, the tracking process can query an electronic source of data such as the Internet for state data 440 regarding the weather for a specific location, such as a location which can be derived through a host pervasive device. Based upon the response, a rain profile can be selected from among the profiles 420 which would include, as an exemplary tracked item, an umbrella. Similarly, where the time of day indicates that it is time to go to work, a work profile can be selected from among the profiles 420 which would include, as an exemplary tracked item, an identification badge. In all cases, when in profile mode, the tracking process 200 can register as items to be tracked 430, those items which are included in the specific profile 450.

Returning now to FIG. 2, beginning first with the process of registering personal articles in the system of FIG. 1, in block 210, the tracking processor 200 can be placed in an inventory mode in which proximately positioned personal articles can be registered into an "inventory" of tracked personal articles. At the outset, in decision block 220 it can be determined whether any RFID tags can be detected in proximity to the tracking processor 200. If not, in block 280 the process can exist as there will be no personal articles to be tracked. Alternatively, the tracking processor 200 can be placed in a profile validation mode in which the current profile, if any, can be confirmed. Where the tracking processor 200 has not been placed in a profile validation mode, it simply can be assumed that there are not articles to be tracked and the process can end.

In any case, so song as an RFID tag can be sensed, in block 230, the tag data for the first sensed RFID tag can be read. In block 240, the tag data can be stored in the inventory. In decision block 250, if more RFID tags have been detected in proximity to the tracking processor 200, in block 270 the next RFID tag can be sensed and the process can repeat in blocks 230 through 250 until all proximate RFID tags have been registered in the inventory. Subsequently, in block 260 the tracking processor 200 can enter a tracking mode. Importantly, it will be recognized by the skilled artisan that the invention is not limited to the storage of any particular type of tag data so long as tag data can be correlated to a particular personal article to be tracked.

FIG. 3 is a flow chart illustrating a process for tracking registered personal articles in the system of FIG. 1, otherwise referred to as a tracking mode in FIG. 2. Once the tracking processor 200 has entered the tracking mode in block 310, in decision block 320, it can be determined whether any RFID tags can be sensed in proximity to the tracking processor 200. If not, it can be presumed that one or more articles have been lost, stolen, forgotten, or otherwise misplaced. Accordingly, in block 390 an alert can be declared. Otherwise, in block 330 the tag data for the sensed RFID tag can be retrieved and matched in block 340 to a registered personal article in the inventor. In decision block 350, if more tags can be sensed in proximity to the tracking processor 200, in block 370 the next tag can be sensed and the process can repeat in blocks 330 through 350.

Importantly, if in decision block 360, not all of the personal articles in the inventor can be accounted for (e.g. the associated RFID tags have been sensed and matched against the inventory), in block 390 an error condition can be declared. Otherwise, the process can repeat through block 310. Notably, the foregoing illustrates only a specific implementation of the process for tracking pre-registered personal articles and is not to be viewed as the exclusive means for tracking personal articles. Specifically, other functionally different processes which achieve the same result are contemplated herein, including a process in which all entries in the inventory are processed in order by actively seeking a corresponding RFID tag in proximity to the tracking processor 200, rather than seeking to match an already sensed RFID tag to an entry in the inventory.

Figure 5:
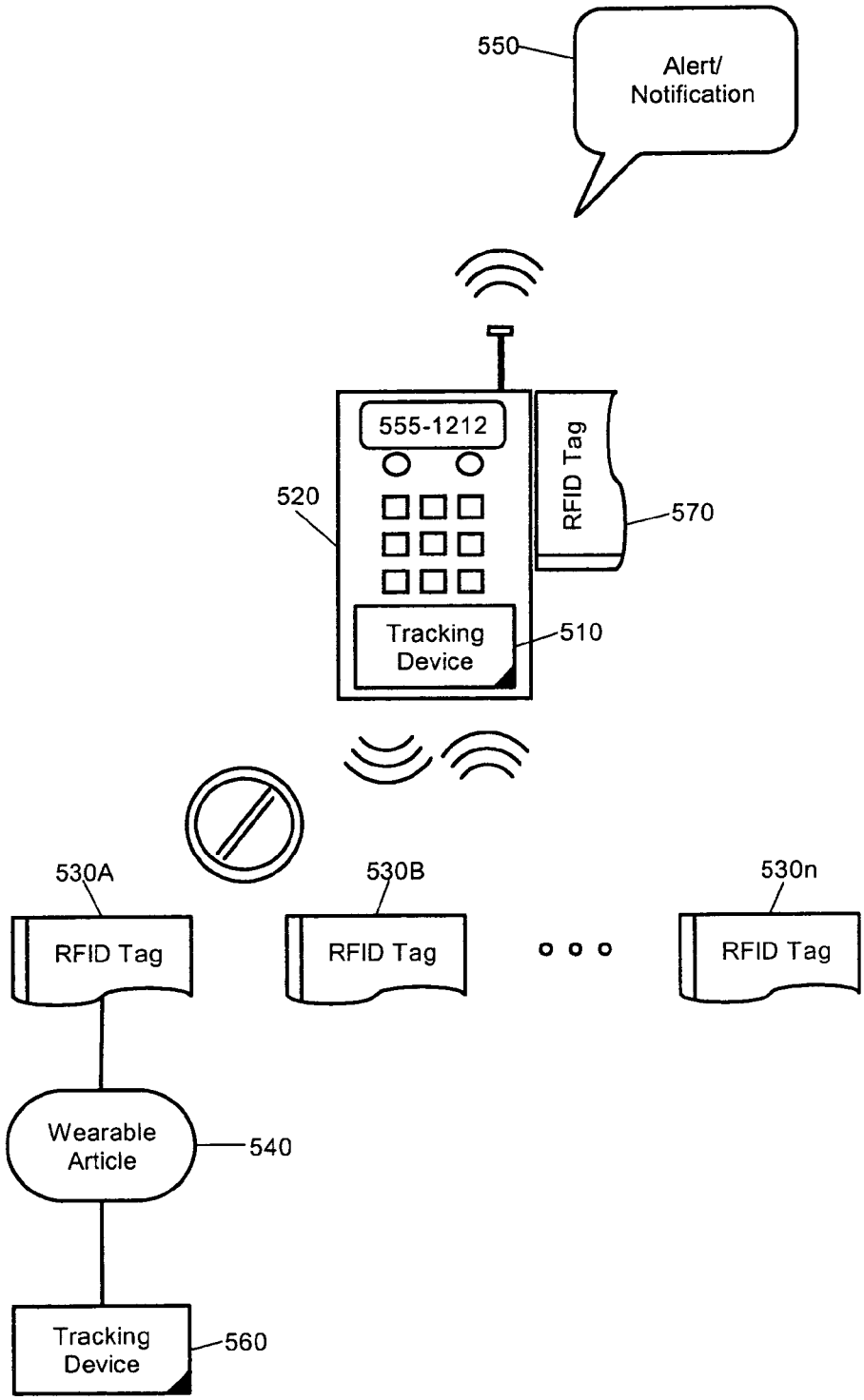

Significantly, the system of FIG. 1 can be adapted in a preferred embodiment for use with a personal article which when lost can pro-actively alert the owner of the loss. In illustration, FIG. 5 depicts a pervasive device, such as a personal digital assistant, wireless pager, or cellular telephone, which has been configured in accordance with the system, method and apparatus of the present invention. The specific embodiment illustrated in FIG. 5 can include a tracking processor 510 which has been coupled to the pervasive device 520. As before, one or more personal articles can be configured with respective RFID tags 530A, 530B, 530*n*. When the pervasive device 520 falls outside of the range of any one of the RFID tags 530A, 530B, 530*n*, an alert 550 can be generated, optionally identifying by name which personal article no longer is proximate to the pervasive device 520.

In an alternative embodiment, the tracking processor 510 within the pervasive device 520 can be logically linked to a particular RFID tag 530A affixed to a specific personal article 540 likely to remain in close proximity to an individual, such as an article of clothing or jewelry. In this way, when the tracking processor 510 no longer can sense the particular RFID tag 530A, it can be presumed that the individual has become separated from the pervasive device 520.

As an alert through the pervasive device 520 would be of no consequence given the separation between individual and pervasive device 520, the pervasive device 520 can pre-programmatically connect to a third party, such as the policy or a third party registry of lost goods to report the loss. At that time, the third party can notify the individual through pre-established means, or the individual, upon recognizing the loss, can contact the third party registry to locate the pervasive device 520 (through e-911 services or GPS location tracking, for instance).

Alternatively, the wearable article 540 can be coupled to a tracking processor 560 which can be logically linked to a particular RFID tag 570 affixed to the pervasive device 520. In this way, when the tracking processor 560 no longer can sense the particular RFID tag 570, it can be presumed that the individual has become separated from the pervasive device 520. Again, an alert can sound so that the individual can avoid traveling too far from the pervasive device 520 thus avoiding the loss or theft of the pervasive device 520.

The method of the present invention can be realized in hardware, software, or a combination of hardware and software. An implementation of the method and system of the present invention can be realized in a centralized fashion in one computer system, or in a distributed fashion where different elements are spread across several interconnected computer systems. Any kind of computer system, or other apparatus adapted for carrying out the methods described herein, is suited to perform the functions described herein. A typical combination of hardware and software could be a general purpose computer system with a computer program that, when being loaded and executed, controls the computer system such that it carries out the methods described herein. The present invention can also be embedded in a computer program product, which comprises all the features enabling the implementation of the methods described herein, and which, when loaded in a computer system is able to carry out these methods.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form. Significantly, this invention can be embodied in other specific forms without departing from the spirit or essential attributes thereof, and accordingly, reference should be had to the following claims, rather than to the foregoing specification, as indicating the scope of the invention.

We claim:

1. A personal articles tracking system comprising:

a radio frequency identification (RFID) reader coupled to a tracking processor;

a data store configured to store tag data from corresponding RFID tags; and, an alert programmed to activate when said tracking processor no longer can sense within range of said RFID reader an RFID tag having corresponding tag data stored in said data store, wherein the tracking processor provides for the selection of a sub-set of registered RFID tags, the alert is programmed to activate upon not all of said selected sub-set of said registered RFID tags having been sensed, said tracking processor, RFID reader and alert are disposed in a pervasive device, and said alert having a communicative linkage to an audio-visual presentation layer provided by said pervasive device.

2. The system of claim 1, wherein said alert further comprises programming to activate when said tracking processor no longer can sense within range of said RFID reader a specific RFID tag.

3. A method for tracking personal articles comprising the steps of:

registering a plurality RFID tags in an inventory or tracked personal articles;

sensing a plurality of proximate RFID tags;

comparing said sensed proximate RFID tags to said registered RFID tags; and, producing an alert where not all of said registered RFID tags have been sensed, wherein said producing step includes the steps of selecting a sub-set of said registered RFID tags, producing an alert wherein not all of said selected sub-set of said registered RFID tags have been sensed, accessing a communications layer in a pervasive device, and, generating a cellular telephone call through said communications layer to a pre-determined third-party to notify said third party that not all of said registered RFID tags have been sensed.

4. The method of claim 3, wherein said selecting step comprises the steps of:

establishing a set of profiles, each profile in said set comprising at least one identifier for a corresponding RFID tag;

selecting a profile from among said established set of profiles; and, including in said sub-set all RFID tags established within said selected profile.

5. A machine readable storage having stored thereon a computer program for tracking personal articles, the computer program comprising a routine set of instructions for causing the machine to perform the steps of:

registering a plurality RFID tags in an inventory or tracked personal articles;

sensing a plurality of proximate RFID tags;

comparing said sensed proximate RFID tags to said registered RFID tags; and, producing an alert where not all of said registered RFID tags have been sensed, wherein said producing step includes the steps of selecting a sub-set of said registered RFID tags, producing an alert wherein not all of said selected sub-set of said registered RFID tags have been sensed, accessing a communications layer in a pervasive device, and, generating a cellular telephone call through said communications layer to a pre-determined third-party to notify said third party that not all of said registered RFID tags have been sensed.

6. The machine readable storage of claim 5, wherein said selecting step comprises the steps of:

establishing a set of profiles, each profile in said set comprising at least one identifier for a corresponding RFID tag;

selecting a profile from among said established set of profiles; and, including in said sub-set all RFID tags established within said selected profile.

* * * * *